US011389000B2

(12) United States Patent
Sun

(10) Patent No.: US 11,389,000 B2
(45) Date of Patent: Jul. 19, 2022

(54) RECLINABLE DIRECTOR CHAIR

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/086,471

(22) Filed: Nov. 2, 2020

(65) Prior Publication Data

US 2021/0393034 A1 Dec. 23, 2021

(30) Foreign Application Priority Data

Jun. 22, 2020 (CN) ..... 202021159919.2

(51) Int. Cl.

| | |
|---|---|
| ***A47C 3/025*** | (2006.01) |
| ***A47C 4/30*** | (2006.01) |
| ***A47C 4/38*** | (2006.01) |
| ***A47C 4/48*** | (2006.01) |
| ***A47C 4/42*** | (2006.01) |
| ***A47C 4/28*** | (2006.01) |

(52) U.S. Cl.

CPC ..... *A47C 3/0252* (2013.01); *A47C 3/025* (2013.01); *A47C 4/283* (2013.01); *A47C 4/30* (2013.01); *A47C 4/38* (2013.01); *A47C 4/42* (2013.01); *A47C 4/48* (2013.01)

(58) Field of Classification Search

CPC ..... A47C 3/0252; A47C 3/025; A47C 4/38; A47C 4/48; A47C 4/283; A47C 4/42; A47C 4/30

USPC ..... 297/45, 259.2, 259.4, 261.4, 268.1

See application file for complete search history.

(56) References Cited

U.S. PATENT DOCUMENTS

| | | | | |
|---|---|---|---|---|
| 10,568,430 | B1 * | 2/2020 | Sun | A47C 3/025 |
| 11,122,903 | B2 * | 9/2021 | Sun | A47C 3/0255 |
| 2014/0097647 | A1 * | 4/2014 | Grace | A47C 3/0255 297/42 |
| 2015/0054314 | A1 * | 2/2015 | Grace | A47C 7/62 297/45 |
| 2019/0313799 | A1 * | 10/2019 | Frankel | A47C 7/70 |
| 2020/0323344 | A1 * | 10/2020 | Zhu | A47C 7/622 |
| 2021/0127836 | A1 * | 5/2021 | Sun | A47C 3/0255 |

* cited by examiner

*Primary Examiner* — Robert Canfield
(74) *Attorney, Agent, or Firm* — WPAT Law, P.C.; Anthony King

(57) ABSTRACT

A reclinable director chair having a chair cloth, a seat frame assembly and a support frame assembly. The seat frame assembly having two cross tubes, two square seat frame armrest tubes and two backrest support tubes, wherein the cross tubes are connected and fixed between the two seat frame armrest tubes in a cross manner. One backrest support tube is disposed at the rear end of each seat frame armrest tube, and a cushion and a backrest of the chair cloth are mounted at upper ends of the cross tubes and on the backrest support tubes, respectively. The support frame assembly having two support frame components. Each support frame component comprises a bottom support tube and a connector.

20 Claims, 12 Drawing Sheets

RECLINABLE DIRECTOR CHAIR

BACKGROUND OF THE INVENTION

1. Technical Field

The utility model belongs to the technical field of chairs, and particularly relates to a director chair with a reclinable

2. Description of Related Art

Nowadays, with the vigorous development of social productive forces, people's material comforts and spiritual pursuits have been greatly improved, more and more large-scale commercial performances, large-scale concerts and evening parties are organized, and some requirements for the comfort and portability of chairs on which users may sit for a long time are put forward. Chairs used on these occasions not only need to be designed to be steady and firm, but also should be attractive, durable and comfortable. Generally, traditional chairs which only allow users to sit thereon are fixed steadily and horizontally, the angle between a horizontal cushion and a vertical backrest perpendicular to the horizontal cushion cannot be adjusted, and once the users feel tired after sitting on the chairs for a long time, the users have to lean their back on the backrest of the chair to relieve fatigue, and in this state, the center of gravity of the users is still focused on the hip and the cushion, so that the feeling of fatigue of the users cannot be effectively eliminated, the users may feel uncomfortable, and the usage requirements of different users cannot be met.

In view of this, it is necessary to improve the chairs used on the site of some large-scale commercial performances, competitive concerts, competition area and the like.

BRIEF SUMMARY OF THE INVENTION

The objective of the utility model is to solve the problem of poor comfort of most existing chairs, used on specific occasions such as large-scale commercial performances, competitive concerts and competition areas, caused by perpendicular arrangement of the backrest and the cushion, and provides a reclinable director chair to improve the long-term sitting comfort of users.

To fulfill the above objective, the utility model adopts the following technical solution:

A reclinable director chair comprises a chair cloth, a seat frame assembly and a support frame assembly, wherein the seat frame assembly comprises two cross tubes, two square seat frame armrest tubes and two backrest support tubes, the cross tubes are connected and fixed between the two seat frame armrest tubes in a cross manner, one backrest support tube is disposed over the rear end of each seat frame armrest tube, and a cushion and a backrest of the chair cloth are mounted at the upper ends of the cross tubes and on the backrest support tubes respectively; and The support frame assembly comprises two support frame component, each support frame component comprises a bottom support tube and a connector, the rear ends of bottom tubes of the seat frame armrest tubes are bent upwards, bent parts of the bottom tubes are rotatably connected to the bottom support tubes, and the two ends of the connector are rotatably connected to the rear end of one bottom tube and the rear end of one bottom support tube, respectively.

Furthermore, each support frame component comprises a foot pad buckle having a lower end fixed to one bottom support tube, and the bent parts of the bottom tubes are rotatably connected to the upper ends of the foot pad buckles.

Furthermore, each support frame component further comprises a rocking chair front pad and a rocking chair bottom pad, wherein the rocking chair front pad and the rocking chair bottom pad are fixedly mounted at the front end and the rear end of one bottom support tube respectively, and when the rotating, the bottom tubes of the seat frame armrest tubes abut against upper surfaces of the rocking chair front pads or the rocking chair bottom pads.

Furthermore, anti-slip grooves are formed in bottom surfaces of the foot pad buckles, the rocking chair front pads and the rocking chair bottom pads.

Furthermore, the connector of the utility model comprises a torsion spring connecting base, a connecting cover, a long hinge pin, a big torsion spring, a middle hinge pin, a small torsion spring and a small hinge pin, wherein a U-shaped support piece is welded to the rear end of each bottom support tube, which is formed with a slot corresponding to the front end of the U-shaped support piece;

A notch is formed in the upper end of the torsion spring connecting base, a horizontal opening allowing the connecting cover to retreat in or stretch out is formed in one side of the notch, the small hinge pin penetrates through the connecting cover mounted in the horizontal opening, and the small torsion spring, one end of the small torsion spring is clamped in a clamping groove in the horizontal opening, the other end of the small torsion spring is clamped in a torsion spring groove in the lower surface of the connecting cover, and a clamping protrusion is arranged on the outer edge of the upper surface of the connecting cover; and sliding grooves are formed in two sides of the notch, and the long hinge pin penetrates through the sliding grooves to be rotatably connected to the rear end of the one seat frame armrest tube;

The big torsion spring, the lower end of the torsion spring connecting base and the U-shaped support piece are rotatably connected through the middle hinge pin; one end of the big torsion spring is inserted into the slot, and the other end of the big torsion spring is clamped in a clamping groove of a spring clamping plate of the torsion spring connecting base.

Furthermore, the connector of the utility model may be of another structure, and particularly, the connector comprises a leaf spring connecting base, a connecting cover, a long hinge pin, a leaf spring, an elastic element mounting shaft, a middle hinge pin, a small torsion spring and a small hinge pin, wherein a U-shaped support piece is welded to the rear end of each bottom support tube, which is formed with a fork hole corresponding to the front end of the U-shaped support piece;

A notch is formed in the upper end of the spring connecting base, a horizontal opening allowing the connecting cover to retreat in or stretch out to cover the horizontal opening of the notch is formed in one side of the notch, the small hinge pin penetrates through the connecting cover in the horizontal opening, and the small torsion spring, one end of the small torsion spring is clamped in a clamping groove in the horizontal opening, the other end of the small torsion spring is clamped in a torsion spring groove in the lower surface of the connecting cover, and a clamping protrusion is arranged on the outer edge of the upper surface of the connecting cover; and sliding grooves are formed in two sides of the notch, and the long hinge pin penetrates through the sliding grooves to be rotatably connected to the rear end of one seat frame armrest tube;

The leaf spring is of a bent structure and stretches to the lower end of the torsion spring connecting base to be wound on the middle hinge pin, a short edge of the leaf spring is inserted into the fork hole, a long edge of the leaf spring is clamped in a concave groove below the leaf spring connecting base, and the lower end of the leaf spring connecting base and the U-shaped support piece are rotatably connected through the middle hinge pin.

Furthermore, each cross tube is of an n-shaped structure formed by a horizontal rod and two symmetrical vertical rods, the vertical rods of the two cross tubes are riveted, and the two ends of each cross rod are riveted to the two vertical tubes of one seat frame armrest tube respectively; and the chair cloth is in an L shape, two vertical sleeve tubes are arranged on the back of the backrest of the chair cloth and are disposed around backrest support tubes, and horizontal sleeve tubes are arranged on two sides of the cushion of the chair cloth and are disposed around the horizontal rods.

Furthermore, the seat frame assembly further comprises four protective sleeves, two connecting iron sheets and two bent iron sheets, wherein the protective sleeves are riveted to the vertical tubes of the seat frame armrest tubes, the two protective sleeves on one seat frame armrest tube are connected to the two bent iron sheets, the two protective sleeves on the other seat frame armrest tube are connected to the two connecting iron sheets, the other ends of the two connecting iron sheets are riveted to the two vertical rods of one cross tube, and the two bent iron sheets are riveted to the two vertical rods of the other cross tube.

Furthermore, the seat frame assembly further comprises four plastic buckles, one plastic buckle is arranged on the upper side of each connecting iron sheet, one plastic buckle is arranged on the upper side of each bent iron sheet, and when the two cross tubes are in an unfolded state, the horizontal rods of the two cross tubes press against the plastic buckles.

Furthermore, the seat frame assembly further comprises U-shaped leaf springs, wherein a protrusion is arranged on a U-shaped face of one side of each U-shaped leaf spring, throats are formed at the lower ends of the backrest support tubes, a through hole is formed in the periphery of each throat, the U-shaped springs are arranged in inner cavities of the throats in a sleeved manner, and the protrusions stretch out of the through holes;

Vertical openings are formed in upper portions of the rear ends of the seat frame armrest tubes, small holes are formed in the side walls of the vertical openings, the throats at the lower ends of the backrest support tubes having the U-shaped leaf springs mounted thereon are inserted into the vertical openings, and the protrusions stretch out of the small holes.

Compared with the prior art, the utility model has the following beneficial effects: the cushion and backrest of the director chair can be reclined to relieve or eliminate the fatigue caused by long-time sitting, and the usage requirement of users for comfort is effectively met; and the reclinable director chair has the advantages of being simple in structure, portable, attractive, elegant, firm, durable, and high in practicability.

In the figures: 1, chair cloth; 2, seat frame assembly; 3, cross tube; 4, support frame assembly; 5, connector; 6, connecting cover; 7, vertical sleeve tube; 8, horizontal sleeve tube; 9, seat frame armrest tube; 10, protective sleeve; 11, plastic buckle; 12, connecting iron sheet; 13, small step shaft; 14, small hollow shaft; 15, long groove; 16, bent iron sheet; 17, small hole; 18, protrusion; 19, backrest support rod; 20, U-shaped leaf spring; 21, rocking chair front pad; 22, anti-slip groove; 23, bottom support tube; 24, foot pad buckle; 25, side cover; 26, rocking chair bottom pad; 27, torsion spring connecting base; 28, bearing; 29, semicircular buckle structure; 30, slot; 31, U-shaped support piece; 32, small hinge pin; 33, clamping protrusion; 34, small torsion spring; 35, big torsion spring; 36, middle hinge pin; 37, long hinge pin; 38, spring clamping plate; 39, torsion spring groove; 40, sliding groove for bearing rolling; 41, leaf spring; 42, bottom support tube II; 43, elastic element mounting shaft; 44, fork leg; 45, leaf spring connecting base; 46, fork hole.

DETAILED DESCRIPTION OF THE INVENTION

To gain a clearer and better understanding of the technical solution of the invention, the technical solution is further expounded below with reference to specific embodiments. Those skilled in the art can easily appreciate other advantages and effects of the invention according to the contents disclosed in this specification. The utility model can also be implemented or applied by means of other different specific embodiments. All details in this specification can be modified or changed without deviating from the spirit of the utility model, based on different viewpoints and applications.

Embodiment 1

Figure 1A:
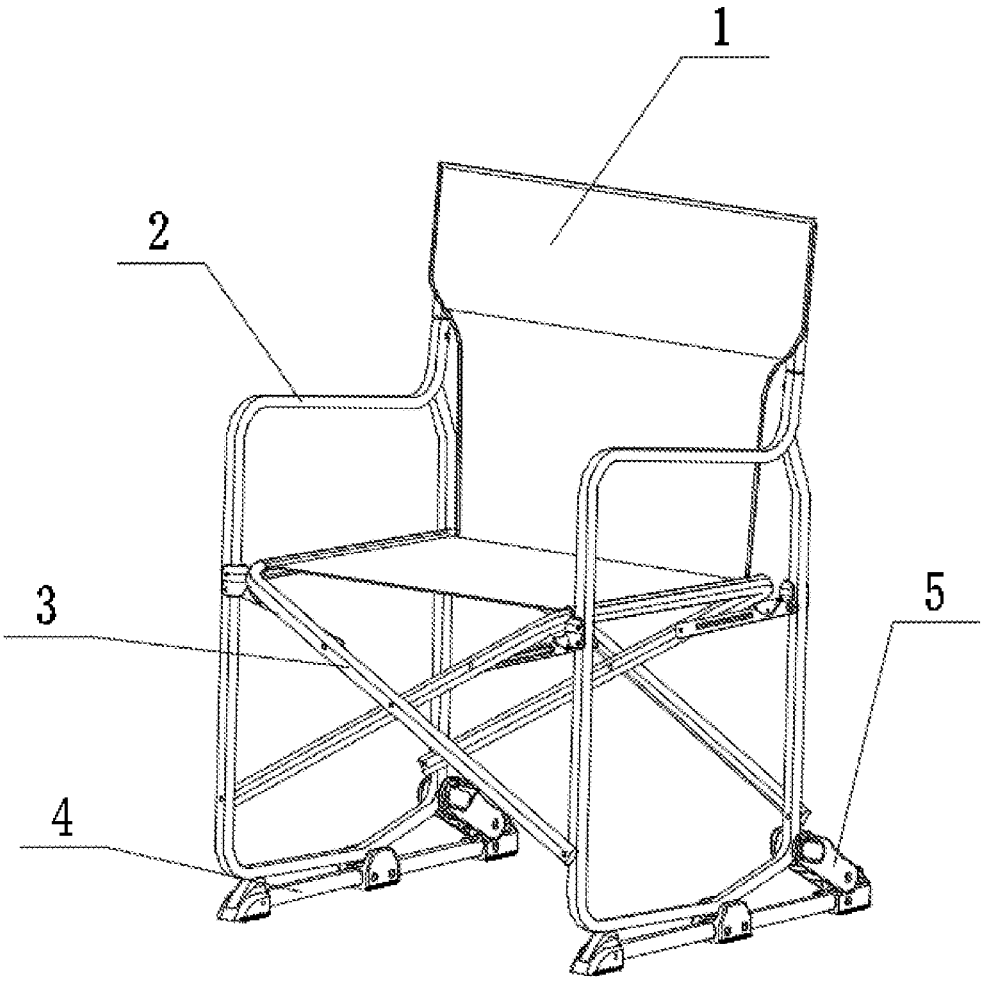
FIG. 1*a* is a front perspective view of a reclinable director chair in a flat state.

This embodiment discloses a reclinable director chair which is mainly characterized in that a cushion and a backrest can be adjusted to a reclining state from a flat state. The reclinable director chair is typically composed of a chair cloth 1, a seat frame assembly 2 and a support frame assembly 4. Assembled parts and assembled structures of the director chair are shown in structural views in the flat state (FIG. 1) and axonometric drawings in the reclining state (FIG. 2), wherein the chair cloth 1 is disposed around the seat frame assembly 2 in an L shape, cross tubes 3 are connected and fixed to the middle of the seat frame assembly 2 in a cross manner, and the support frame assembly 4 is connected to the bottom of the seat frame assembly 2 and is supported on the ground.

Figure 3:
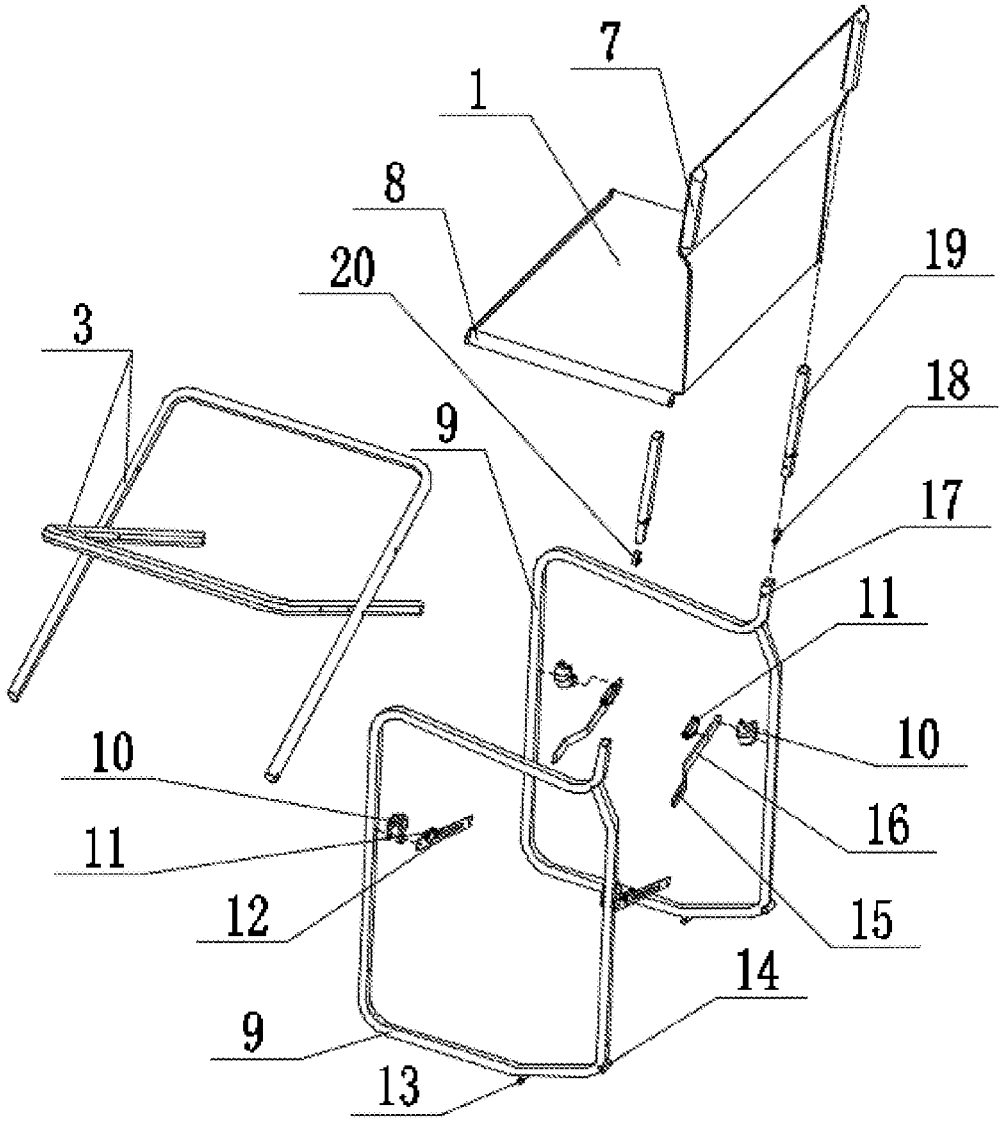
FIG. 3 is an exploded view of a seat frame assembly of the reclinable director chair.
Figure 4A:
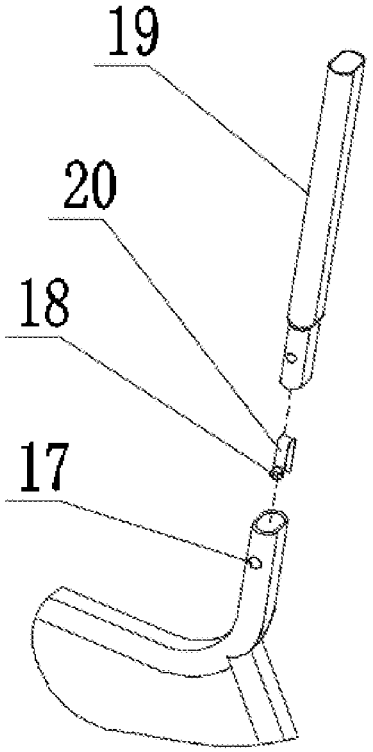
FIG. 4*a* is a disassembled explosive view of a cross tube and a U-shaped leaf spring.
Figure 4B:
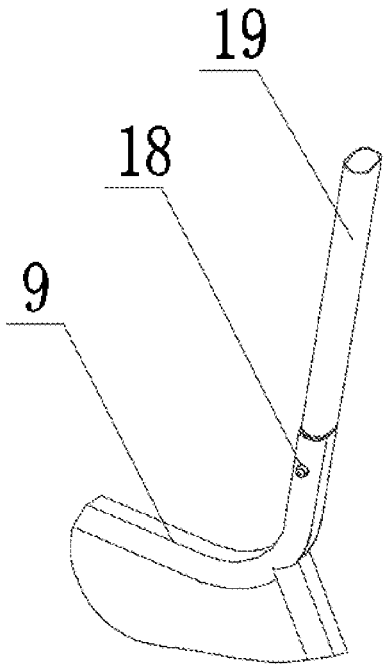
FIG. 4*b* is an assembled view of the cross tube and the U-shaped leaf spring.

As shown in FIG. 3, the chair cloth 1 is in an L shape, two vertical sleeve tubes 7 are designed behind a backrest side of the chair cloth 1 and allow two backrest support rods 19 disposed around the seat frame assembly 2 to be mounted therein, and horizontal sleeve tubes 8 are designed on two sides of a cushion side of the chair cloth 1 and are disposed around two horizontal rods of the two cross tubes 3.

Specifically, the reclinable director chair comprises the chair cloth 1, the seat frame assembly 2 and the support frame assembly 4, wherein the seat frame assembly 2 comprises the two cross tubes 3, two square seat frame armrest tubes 9 and two backrest support tubes 19, wherein the cross tubes 3 are connected and fixed between the two seat frame armrest tubes 9 in a cross manner, one backrest support tube 19 is arranged over the rear end of each seat frame armrest tube 9, and a cushion and a backrest of the chair cloth 1 are mounted at the upper ends of the cross tubes 3 and on the backrest support tubes 19, respectively; the support frame assembly 4 comprises two support frame components, each support frame component comprises a bottom support tube 23 and a connector 5, the rear ends of bottom tubes of the seat frame armrest tubes 9 are bent upwards, bent parts of the bottom tubes are rotatably connected to the bottom support tubes 23, and the two ends of each connector 5 are rotatably connected to the rear end of one bottom tube and the rear end of one bottom support tube 23, respectively.

Figure 5:
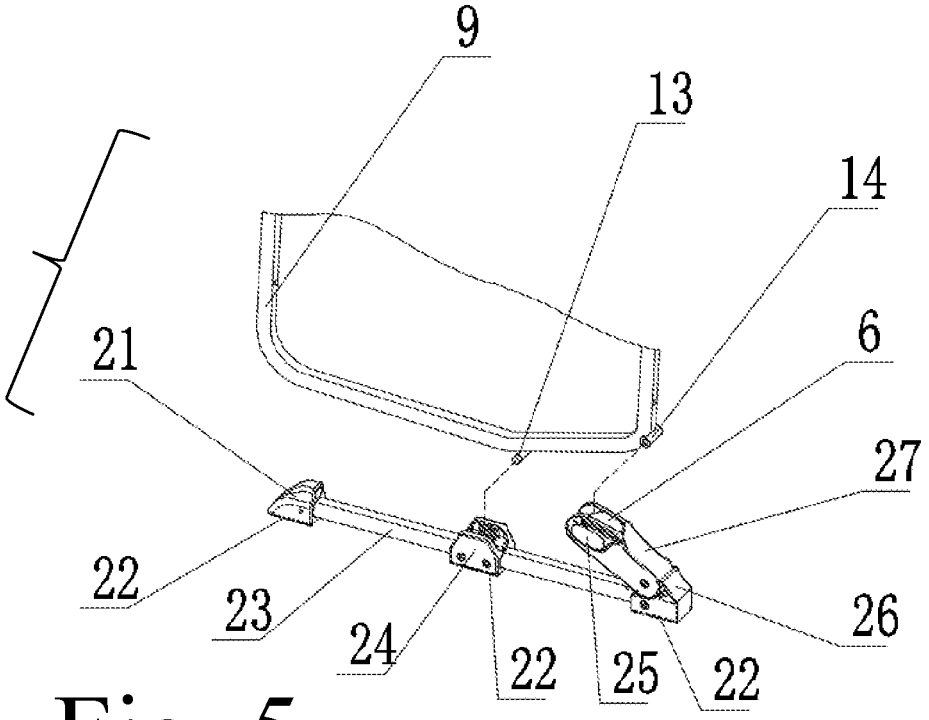
FIG. 5 is an explosive view of a support frame and a seat frame assembly of the reclinable director chair.
Figure 6:
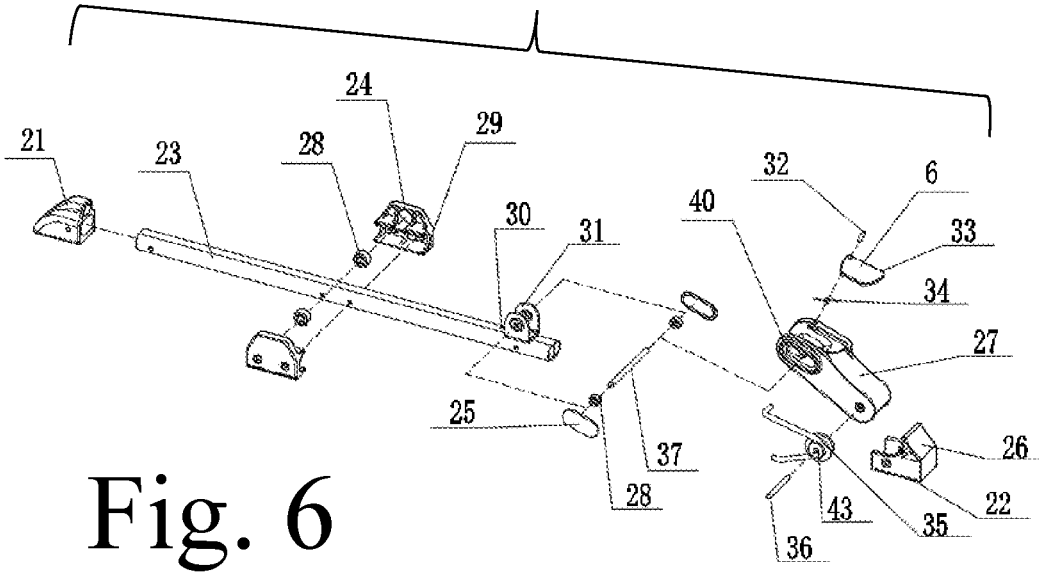
FIG. 6 is an exploded view of a support frame component in FIG. 5.

On the basis of the bottom support tube 23 and the connector 5, each support frame component of the support frame assembly 4 of the reclinable director chair, as shown in FIG. 5 and FIG. 6, further comprises a foot pad buckle 24, a rocking chair front pad 21 and a rocking chair bottom pad 26, wherein the lower end of the food pad buckle 24 is fixed to the bottom support tube 23, and the rocking chair front pad 21 and the rocking chair bottom pad 26 are disposed around the front end and the rear end of the bottom support tube 23 respectively. Wherein, the bent parts of the bottom tubes are rotatably connected to the upper ends of the foot pad buckles 24, the rocking chair front pads 21 and the rocking chair bottom pads 26 are fixedly mounted at the front ends and the rear ends of the bottom support tubes 23 respectively, and when rotating, the bottom tubes of the seat frame armrest tubes 9 abut against the upper surfaces of the rocking chair front pads 21 or the rocking chair bottom pads 26.

The rocking chair bottom pad 26 is mounted at the other end of the bottom support tube 23 with a rivet (or screw), and an anti-slip groove 22 is designed in the bottom surface of the rocking chair bottom pad 26. The rocking chair front pad 21 is similar to human's forefeet in shape, an anti-slip groove 22 is designed in a side, in contact with the ground, of the rocking chair front pad 21, an oblate hole matched with the bottom support tube 23 is formed in a flat end of the rocking chair front pad 21, and the rocking chair front pad 21 is disposed around one end of the bottom support tube 23 and penetrates through the oblate hole to be fixed to the bottom support tube 23 with a rivet (or screw). Through the design of the anti-slip groove 22, the anti-slip performance of the rocking chair bottom pad is improved, and the director chair can be placed more steadily. The rocking chair front pad 21 is preferably made of rubber.

As a specific structure of the foot pad buckle, the foot pad buckle 24 in this embodiment, as shown in FIG. 5 and FIG. 6, is formed by two symmetrical parts and two bearings 28 which are assembled together, and is arranged close to the middle of the bottom support tube 23, wherein the two symmetrical parts of the foot pad buckle 24 are fixedly mounted with rivets (or screws), the lower end of one symmetrical part is buckled on an oblate shell of the bottom support tube 23 in a half-closed manner through a semicircular buckle structure 29 and realizes a closed state together with the other symmetrical part, semicircular notches are formed in the sides, towards one seat frame armrest tube 9, of the symmetrical parts, one seat frame armrest tube 9 is mounted in bearing seat mounting holes in two sides of the semicircular notches of the foot pad buckle 24 through a small step shaft 13 and the bearings 28. An anti-slip groove 22 is also designed in the side, towards the ground, of the rocking chair bottom pad 26.

Figure 7A:
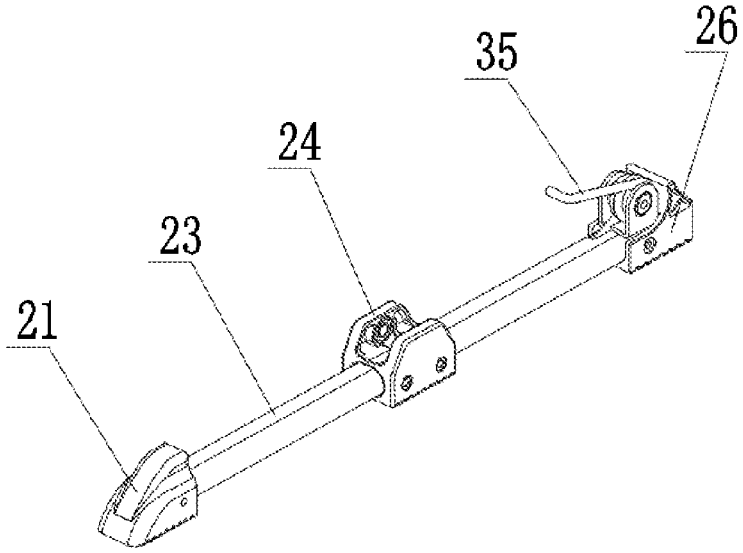
FIG. 7*a* is a connection diagram of a big torsion spring in FIG. 5.
Figure 7B:
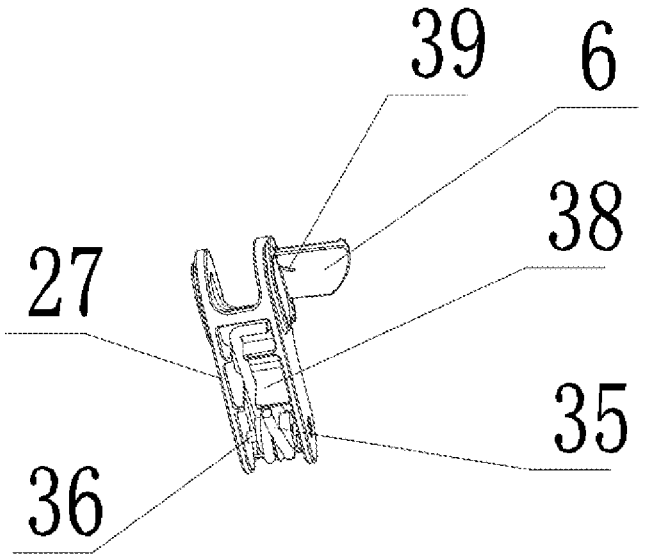
FIG. 7*b* is a schematic diagram of the big torsion spring with the bottom turned in FIG. 5.

In one specific implementation, the connector 5 comprises a torsion spring connecting base 27, a connecting cover 6, a long hinge pin 37, a big torsion spring 35, a middle hinge pin 36, a small torsion spring 34 and a small hinge pin 32, wherein a U-shaped support piece 31 is welded to the upper surface of the rear end of each bottom support tube 23, which is formed with a slot 30 corresponding to the front end of the U-shaped support piece 31; a notch is formed in the upper end of the torsion spring connecting base 27 and is of a Y-shaped structure, a horizontal opening allowing the connecting cover 6 to retreat in or stretch out (or to slide) is formed in one side of the notch, the small hinge pin 32 penetrates through the connecting cover 6 mounted in the horizontal opening, and the small torsion spring 34, one end of the small torsion spring 34 is clamped in a clamping groove in the horizontal opening, the other end of the small torsion spring 34 is clamped in a torsion spring groove 39 in the lower surface of the connecting cover 6, and a clamping protrusion 33 is arranged on the outer edge of the upper surface of the connecting cover 6; sliding grooves 40 are formed in two sides of the notch, and the long hinge pin 37 penetrates through the sliding grooves 40 to be rotatably connected to the rear end of one seat frame armrest tube 9; the big torsion spring 35, the lower end of the torsion spring connecting base 27 and the U-shaped support piece 31 are rotatably connected through the middle hinge pin 36; one end of the big torsion spring 35 is inserted into the slot 30, and the other end of the big torsion spring 35 is clamped in a clamping groove of a spring clamping plate 38 of the torsion spring connecting base 27 (as shown in FIG. 7). The connecting cover 6 is mainly used to cover the notch; in the case where the connecting cover 6 is not pushed with an external force, the connecting cover 6 covers the Y-shaped notch of the torsion spring connecting base 27 under the effect of the small torsion spring 34, and the clamping protrusion 33 is exactly clamped outside the side edge of the Y-shaped notch of the torsion spring connecting base 27. Preferably, the side edge, towards the corresponding seat frame armrest tube 9, of the connecting cover 6 is designed as an oblique edge.

In addition, the connector 5 further comprises two side covers 25, two bearings 28 and an elastic element mounting shaft 43, wherein a rotating part of the big torsion spring 35 is mounted on the elastic element mounting shaft 43, the middle hinge pin 36 penetrates through the elastic element mounting shaft 43, and the entire torsion spring connecting base 27 is mounted on and rotatably connected to the U-shaped support piece 31 of the bottom support tube 23 through the middle hinge pin 36. The long hinge pin 37 penetrates through the corresponding seat frame armrest tube 9 through a small hollow shaft 14, the bearings 28 are mounted at the two ends of the long hinge pin 37 and are arranged in the sliding grooves 40 of the torsion spring connecting base 27 in a rolling and sliding manner, and horizontal openings of the sliding grooves 40 in two sides of the Y-shaped open end of the torsion spring connecting base 27 are covered with the two side covers 25.

In a preferred implementation, each cross tube 3, as shown in FIG. 1*a*-FIG. 3, is of an n-shaped structure formed by a horizontal rod and two symmetrical vertical rods, the vertical rods of the two cross tubes 3 are riveted (with rivets or screws), and the two symmetrical ends of each horizontal rod are riveted to the two vertical tubes of one seat frame armrest tube 9, respectively; the chair cloth 1 is in an L shape, two vertical sleeve tubes 7 are arranged on the back side of the backrest of the chair cloth 1 and are disposed around backrest support tubes 19, and horizontal sleeve tubes 8 are arranged on two sides of the cushion of the chair cloth 1 and are disposed around the horizontal rods.

Preferably, the seat frame assembly further comprises four protective sleeves 10, two connecting iron sheets 12 and two bent iron sheets 16, wherein the protective sleeves 10 are riveted to the vertical tubes of the seat frame armrest tubes 9, the two protective sleeves 10 on one seat frame armrest tube 9 are connected to the two bent iron sheets 16, the two protective sleeves 10 on the other seat frame armrest tube 9 are connected to the two connecting iron sheets 12, the other ends of the two connecting iron sheets 12 are riveted to the two vertical rods of one cross tube 3, and the two bent iron sheets 16 are riveted to the two vertical rods of the other cross tube 3. The two cross tubes 3 are mounted between the two seat frame armrest tubes 9 in a cross manner, the upper ends, namely the horizontal rods, are connected to the two bent iron sheets and the two connecting iron sheets 12 through rivets (or screws), and the lower ends (open ends) are connected to the two seat frame armrest tubes 9 through rivets (or screws). A long groove 15 is formed in one of the two bent iron sheets 16 to be used for assembly and adjustment.

Preferably, the seat frame assembly in this embodiment further comprises four plastic buckles 11, one plastic buckle 11 is bucked on the upper side of each connecting iron sheet 12, one plastic buckle 11 is buckled on the upper side of each bent iron sheet 16, and the four plastic buckles 11 are fixedly connected through rivets (or screws). When the two cross tubes are in an unfolded state, the horizontal rods of the two cross tubes 3 press against the plastic buckles 11.

Preferably, the seat frame assembly in this embodiment further comprises U-shaped leaf springs 20, a protrusion 18 is arranged on the U-shaped face of one side of each U-shaped leaf spring 20, throats are arranged at the lower ends of the backrest support tubes 19, a through hole is formed in the periphery of each throat, the U-shaped leaf springs 20 are arranged in inner cavities of the throats in a sleeved manner, and the protrusions 18 stretch out of the through holes; and vertical openings are formed in upper portions of the rear ends of the seat frame armrest tubes 9, small holes 17 are formed in the side walls of the vertical openings, the throats at the lower ends of the backrest support tubes 19 having the U-shaped leaf spring 20 mounted thereon are inserted into the vertical openings, and the protrusions 18 stretch out of the small holes 17.

Figure 1B:
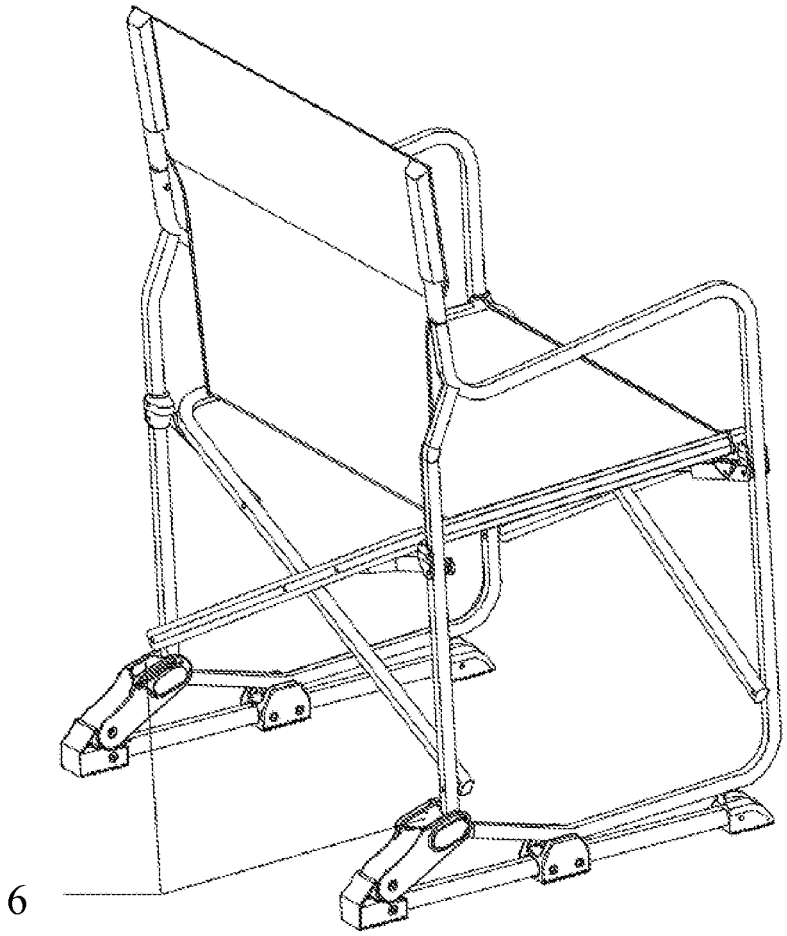
FIG. 1*b* is a back perspective view of the reclinable director chair in the flat state.

As shown in FIG. 1, in the case where a user horizontally sits on the director chair, the working condition of the director chair adopting the cross tubes and the torsion springs is as follows:

When the user sits on the reclinable director chair which is flatly placed on the ground, the whole director chair is pressed to rotate forward around a fulcrum formed by the small step shafts 13 and the foot pad buckles 24 on the seat frame armrest tubes 9 and the bearings 28, under the effect of the center gravity of the user, so that the front ends of the lower oblate tubes of the seat frame armrest tubes 9 are pressed against the shells of the rocking chair front pads 21. At this moment, the big torsion springs 35 are assembled and pre-tightened between the torsion spring connecting bases 27 and the bottom support tubes 23, the connecting covers 6 block the Y-shaped notches of the torsion spring connecting bases 27 under the assembling and pre-tightening effect of the small torsion springs 34, so that the Y-shaped notches are sealed and covered (foreign matter or fingers are prevented from being stretched into the Y-shaped notches by mistake, otherwise, the fingers may be pinched when the seat frame armrest tubes 9 are reclined).

Figure 2A:
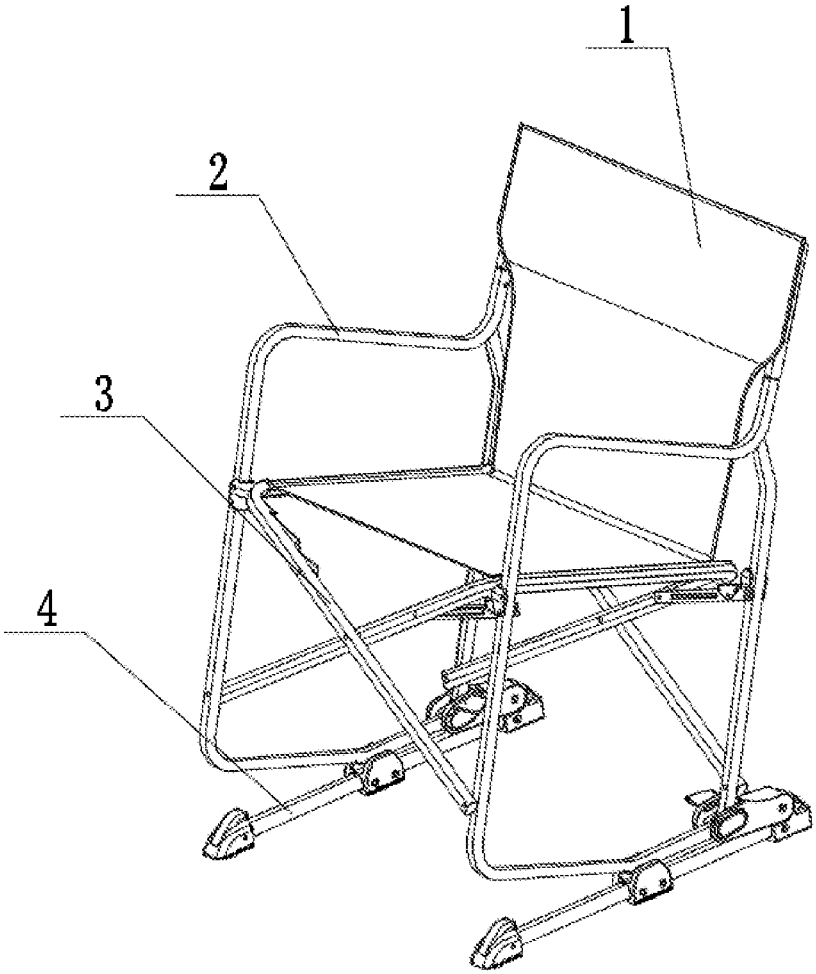
FIG. 2*a* is a front perspective view of the reclinable director chair in a reclining state.
Figure 2B:
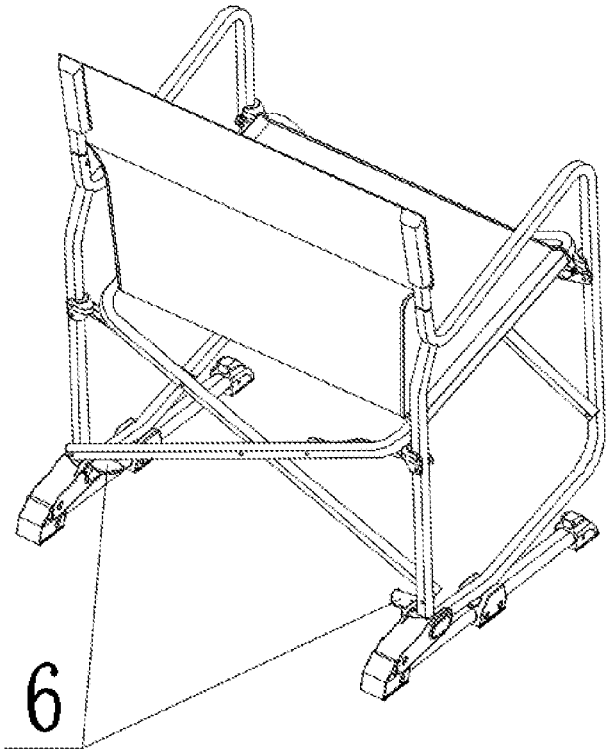
FIG. 2*b* is a back perspective view of the reclinable director chair in the reclining state.

As shown in FIG. 2, the operating principle of the director chair adopting the cross tubes and the torsion springs and allowing the user to recline thereon is as follows:

When the user sits on the director chair adopting the cross tubes and the torsion springs and reclines by a certain angle, the whole director chair is pressed to rotate backwards around fulcrum formed by the small step shafts 13 and the foot pad buckles 24 on the seat frame armrest tubes 9 and the bearings 28, with the backward movement of the center gravity of the user, so that the front ends of the lower oblate tubes of the seat frame armrest tubes 9 are separated from the shells of the rocking chair front pads 21. At this moment, the big torsion springs 35 are stressed and pressed between the torsion spring connecting bases 27 and the bottom support tubes 23, the seat frame armrest tubes 9 roll and slide in the sliding grooves 40 for bearings rolling of the torsion spring connecting bases 27 through the small hollow shafts 14, the long hinge pins 37 and the bearings 28, so that the whole torsion spring connecting bases 27 can rotate towards the bottom support tubes 23 around the fulcrum formed by the U-shaped support pieces 31 and the middle hinge pins 36 on the bottom support tubes 23. At this moment, the oblique edges of the connecting covers 6 are squeezed by the inclining seat frame armrest tubes 9 to rotate towards the outside of the Y-shaped notches of the torsion spring connecting bases 27 around the fulcrum formed by the small torsion springs 34 and the small hinge pins 32. When the oblate tubes on the small hollow shafts 14 of the seat frame armrest tubes 9 are completely clamped in the most concave portions of the Y-shaped notches of the torsion spring connecting bases 27, and at this moment, the director chair with the cross tubes and the torsion springs are reclined by the maximum angle (an angle range allowing the user to comfortably, stably and safely recline on the chair).

Embodiment 2

Figure 8A:
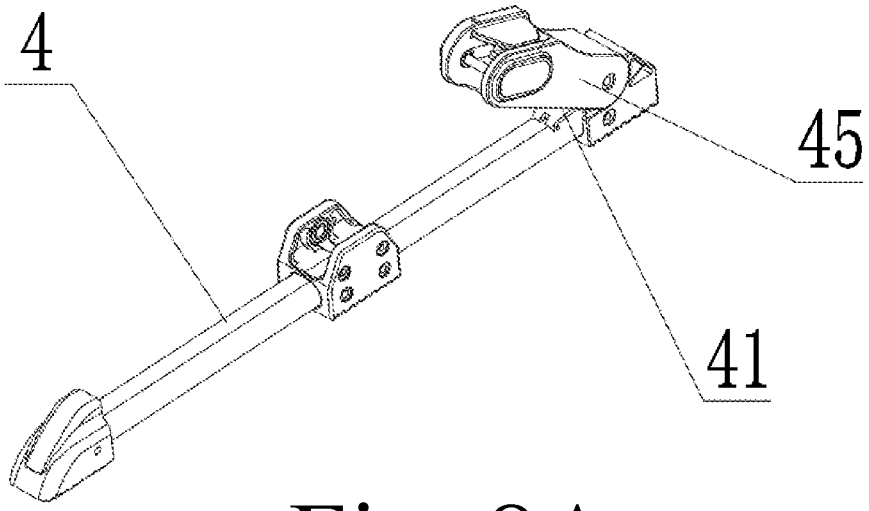
FIG. 8*a* is an assembled diagram of another support frame component of the reclinable director chair.
Figure 8B:
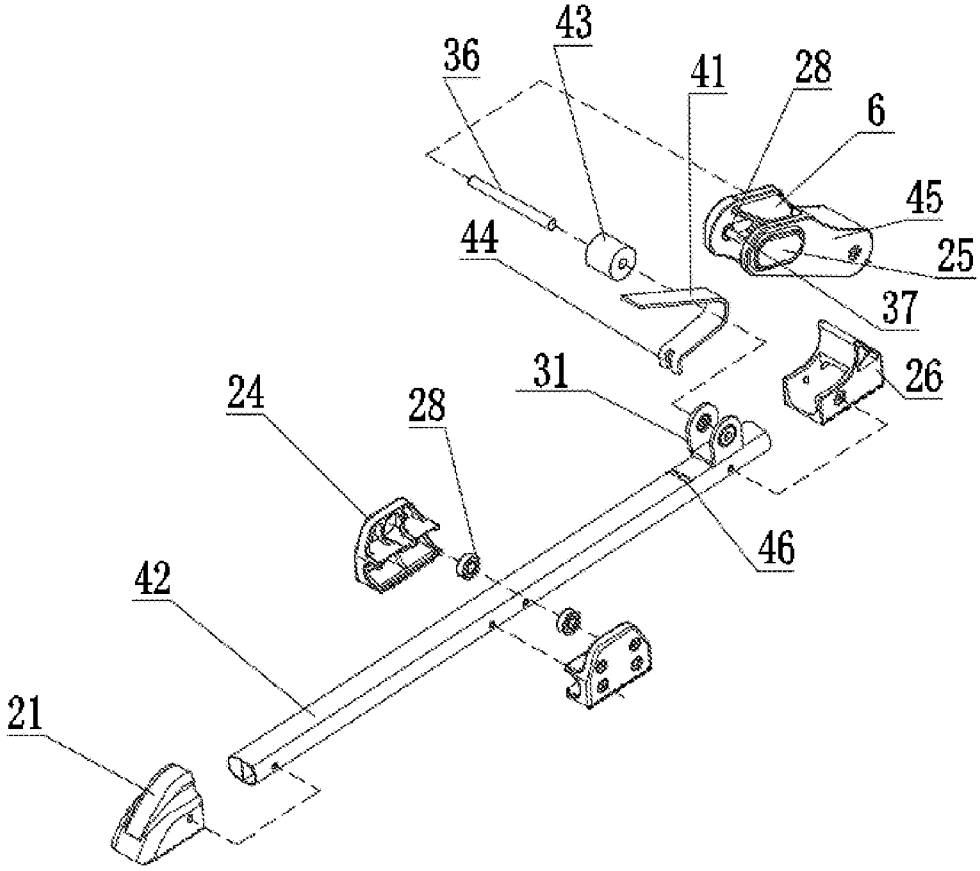
FIG. 8*b* is a disassembled view of another support frame component of the reclinable director chair.
Figure 9:
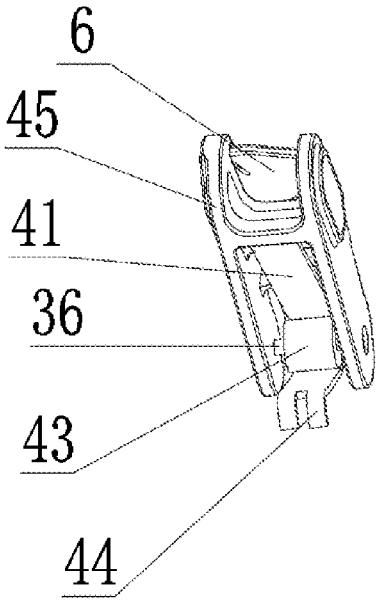
FIG. 9 is a connection diagram of a leaf spring in FIG. 8.

Different from Embodiment 1, this embodiment provides a support frame assembly 4 of another structure, which is different from support frame assembly in the above embodiment mainly in the connector 5 and adopts leaf spring components, as shown in FIG. 8*a*, FIG. 8*b* and FIG. 9. The overall assembled diagram of the support frame assembly 4 adopting the leaf spring structure is shown in FIG. 8*a*, and the exploded view of the parts of the support frame assembly 4 adopting the leaf spring structure is shown in FIG. 8*b*. Specifically, each support frame component of the support frame assembly 4 in this embodiment is mainly composed of a rocking chair front pad 21, a bottom support tube II 42, two foot pad buckles 24, a rocking chair bottom pad 26, two bearings 28 and two connectors 5, wherein the rocking chair front pad 21, the bottom support tube II 42, the two foot pad buckles 24 and the rocking chair bottom pad 26 are connected in the same manner as Embodiment 1. The connector 5 comprises a leaf spring connecting base 45, a connecting cover 6, two side covers 25, two bearings 28, a long hinge pin 37, a leaf spring 41, an elastic element mounting shaft 43, a middle hinge pin 36, a small torsion spring 34 and a small hinge pin 32, wherein a U-shaped support piece 31 is welded to the rear end of each bottom support tube 23, which is formed with a fork hole 46 corresponding to the front end of the U-shaped support piece 31;

A notch is formed in the upper end of the leaf spring connecting base 45, a horizontal opening allowing the connecting cover 6 to retreat in or stretch out to cover the notch is formed in one side of the notch, the small hinge pin 32 penetrates through the connecting cover 6 mounted in the horizontal opening, and the small torsion spring 34, one end of the small torsion spring 34 is clamped in a clamping groove in the horizontal opening, the other end of the small torsion spring 34 is clamped in a torsion spring groove 39 in the lower end face of the connecting cover 6, and a clamping protrusion 33 is arranged on the outer edge of the upper surface of the connecting cover 6; sliding grooves 40 are formed in two sides of the notch, and the long hinge pin 37 penetrates through the sliding grooves 40 to be rotatably connected to the rear end of one seat frame armrest tube 9; the leaf spring 41 is of a bent structure and stretches to the lower end of one torsion spring connecting base 27 to be wound on the middle hinge pin 36; a short edge of the leaf spring 41 is inserted into the fork hole 46, a long edge of the leaf spring 41 is clamped in a concave groove below the leaf spring connecting base 45, and the lower end of the leaf spring 45 and the U-shaped support piece 31 are rotatably connected through the middle hinge pin 36.

Preferably, the connector 5 in this embodiment further comprises two side covers 25, two bearings 28 and an elastic element mounting shaft 43, wherein a bent part (an arc wrap angle formed by the long edge and the short edge) of the leaf spring 41 is wound on the elastic element mounting shaft 43, the middle hinge pin 36 penetrates through the elastic element mounting shaft 43, and the whole torsion spring connecting base 27 is mounted on and rotatably connected to the U-shaped support piece 31 of one bottom support tube 23 through the middle hinge pin 36. The long hinge pin 37 penetrates through the seat frame armrest tube 9 through a small hollow shaft 14, the bearings 28 are mounted at the two ends of the long hinge pin 37 and are arranged in the sliding grooves 40 of the torsion spring connecting base 27 in a rolling and sliding manner, and horizontal openings of the sliding grooves 40 in the two sides of the Y-shaped open end of the torsion spring connecting base 27 are covered with the two side covers 25.

In one implementation, the leaf spring 41 is in the shape of an open fork, wherein two fork legs 44 are arranged on a short edge of the leaf spring and are inserted into the two fork holes 46 which are correspondingly designed in the bottom support tube II 42.

The above embodiments are merely preferred ones of the utility model, and are not intended to limit the protection scope of the utility model. All transformations and improvements made by those skilled in the art according to the design concept of the utility model should also fall within the protection scope of the utility model. More specifically, various transformations and improvements can be made to the components and/or layout of the subject matter of the utility model within the scope defined by the disclosure, drawings and claims of this application. In addition to the transformations and improvements made to the components and/or layout of the subject matter, other applications of the utility model will also be obvious to those skilled in the art.

What is claimed is:

1. A reclinable director chair, comprising a chair cloth (1), a seat frame assembly (2) and a support frame assembly (4), wherein the seat frame assembly (2) comprises two cross tubes (3), two seat frame armrest tubes (9) and two backrest support tubes (19), the cross tubes (3) are connected and fixed between the two seat frame armrest tubes (9) in a cross manner, one said backrest support tube (19) is disposed at a rear end of each said seat frame armrest tube (9), and a cushion and a backrest of the chair cloth (1) are mounted at upper ends of the cross tubes (3) and on the backrest support tubes (19) respectively; and the support frame assembly (4) comprises two support frame component, each said support frame components comprises a bottom support tube (23) and a connector (5), rear ends of bottom tubes of the seat frame armrest tubes (9) are bent upwards, bent parts of the bottom tubes are rotatably connected to the bottom support tubes (23), and two ends of the connector (5) are rotatably connected to the rear end of one said bottom tube and a rear end of one said bottom support tube (23), respectively.

2. The reclinable director chair according to claim 1, wherein each said support frame component comprises a foot pad buckle (24) having a lower end fixed to one said bottom support tube (23), and the bent parts of the bottom tubes are rotatably connected to upper ends of the foot pad buckles (24).

3. The reclinable director chair according to claim 2, wherein the connector (5) comprises a torsion spring connecting base (27), a connecting cover (6), a first hinge pin (37), a first torsion spring (35), a middle hinge pin (36), a second torsion spring (34) and a second hinge pin (32), wherein a U-shaped support piece (31) is welded to the rear end of each said bottom support tube (23), which is formed with a slot (30) corresponding to a front end of the U-shaped support piece (31);

a notch is formed in an upper end of the torsion spring connecting base (27), a horizontal opening allowing the connecting cover (6) to retreat in or stretch out is formed in one side of the notch, the second hinge pin (32) penetrates through the connecting cover (6) mounted in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the first torsion spring (35), a lower end of the torsion spring connecting base (27) and the U-shaped support piece (31) are rotatably connected through the middle hinge pin (36); one end of the first torsion spring (35)

is inserted into the slot (30), and another end of the first torsion spring (35) is clamped in a clamping groove of a spring clamping plate (38) of the torsion spring connecting base (27).

4. The reclinable director chair according to claim 2, wherein the connector (5) comprises a leaf spring connecting base (45), a connecting cover (6), a first hinge pin (37), a leaf spring (41), an elastic element mounting shaft (43), a middle hinge pin (36), a second torsion spring (34) and a second hinge pin (32), wherein a U-shaped support piece (31) is welded to the rear end of each said bottom support tube (23), which is formed with a fork hole (46) corresponding to a front end of the U-shaped support piece (31);

a notch is formed in an upper end of the spring connecting base (45), a horizontal opening allowing the connecting cover (6) to retreat in or stretch out to cover the horizontal opening of the notch is formed in one side of the notch, the second hinge pin (32) penetrates through the connecting cover (6) in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the leaf spring (41) is of a bent structure and stretches to a lower end of the torsion spring connecting base (27) to be wound on the middle hinge pin (36), a first edge of the leaf spring (41) is inserted into the fork hole (46), a second edge of the leaf spring (41) is clamped in a concave groove below the leaf spring connecting base (45), and a lower end of the leaf spring connecting base (45) and the U-shaped support piece (31) are rotatably connected through the middle hinge pin (36).

5. The reclinable director chair according to claim 2, wherein each said cross tube (3) is of an n-shaped structure formed by a horizontal rod and two symmetrical vertical rods, the vertical rods of the two cross tubes (3) are riveted, and two ends of each said cross rod are riveted to the two vertical tubes of one said seat frame armrest tube (9); and the chair cloth (1) is in an L-shape, two vertical sleeve tubes (7) are arranged on a back of the backrest of the chair cloth (1) and are disposed around backrest support tubes (19), and horizontal sleeve tubes (8) are arranged on two sides of the cushion of the chair cloth (1) and are disposed around the horizontal rods (8).

6. The reclinable director chair according to claim 2, wherein the seat frame assembly further comprises four protective sleeves (10), two connecting iron sheets (12) and two bent iron sheets (16), wherein the protective sleeves (10) are riveted to vertical tubes of the seat frame armrest tubes (9), the two protective sleeves (10) on one said seat frame armrest tube (9) are connected to the two bent iron sheets (16), the two protective sleeves (10) on the other seat frame armrest tube (9) are connected to the two connecting iron sheets (12), another ends of the two connecting iron sheets (12) are riveted to the two vertical rods of one said cross tube (3), and the two bent iron sheets (16) are riveted to the two vertical rods of the other cross tube (3).

7. The reclinable director chair according to claim 2, wherein each said support frame component further comprises a rocking chair front pad (21) and a rocking chair bottom pad (26), wherein the rocking chair front pad (21) and the rocking chair bottom pad (26) are fixedly mounted at a front end and a rear end of one said bottom support tube (23) respectively, and when the rotating, the bottom tubes of the seat frame armrest tubes (9) abut against upper surfaces of the rocking chair front pads (21) or the rocking chair bottom pads (26).

8. The reclinable director chair according to claim 7, wherein the connector (5) comprises a torsion spring connecting base (27), a connecting cover (6), a first hinge pin (37), a first torsion spring (35), a middle hinge pin (36), a second torsion spring (34) and a second hinge pin (32), wherein a U-shaped support piece (31) is welded to the rear end of each said bottom support tube (23), which is formed with a slot (30) corresponding to a front end of the U-shaped support piece (31);

a notch is formed in an upper end of the torsion spring connecting base (27), a horizontal opening allowing the connecting cover (6) to retreat in or stretch out is formed in one side of the notch, the second hinge pin (32) penetrates through the connecting cover (6) mounted in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the first torsion spring (35), a lower end of the torsion spring connecting base (27) and the U-shaped support piece (31) are rotatably connected through the middle hinge pin (36); one end of the first torsion spring (35) is inserted into the slot (30), and another end of the first torsion spring (35) is clamped in a clamping groove of a spring clamping plate (38) of the torsion spring connecting base (27).

9. The reclinable director chair according to claim 7, wherein the connector (5) comprises a leaf spring connecting base (45), a connecting cover (6), a first hinge pin (37), a leaf spring (41), an elastic element mounting shaft (43), a middle hinge pin (36), a second torsion spring (34) and a second hinge pin (32), wherein a U-shaped support piece (31) is welded to the rear end of each said bottom support tube (23), which is formed with a fork hole (46) corresponding to a front end of the U-shaped support piece (31);

a notch is formed in an upper end of the spring connecting base (45), a horizontal opening allowing the connecting cover (6) to retreat in or stretch out to cover the horizontal opening of the notch is formed in one side of the notch, the second hinge pin (32) penetrates through the connecting cover (6) in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the leaf spring (41) is of a bent structure and stretches to a lower end of the torsion spring connecting base (27) to be wound on the middle hinge pin (36), a first edge of the leaf spring (41) is inserted into the fork hole (46), a second edge of the leaf spring (41) is clamped in a concave groove below the leaf spring connecting base (45), and a lower end of the leaf spring connecting base (45) and the U-shaped support piece (31) are rotatably connected through the middle hinge pin (36).

10. The reclinable director chair according to claim 7, wherein each said cross tube (3) is of an n-shaped structure formed by a horizontal rod and two symmetrical vertical rods, the vertical rods of the two cross tubes (3) are riveted, and two ends of each said cross rod are riveted to the two vertical tubes of one said seat frame armrest tube (9); and the chair cloth (1) is in an L-shape, two vertical sleeve tubes (7) are arranged on a back of the backrest of the chair cloth (1) and are disposed around backrest support tubes (19), and horizontal sleeve tubes (8) are arranged on two sides of the cushion of the chair cloth (1) and are disposed around the horizontal rods (8).

11. The reclinable director chair according to claim 7, wherein anti-slip grooves (22) are formed in bottom surfaces of the foot pad buckles (24), the rocking chair front pads (21) and the rocking chair bottom pads (26).

12. The reclinable director chair according to claim 11, wherein the connector (5) comprises a torsion spring connecting base (27), a connecting cover (6), a first hinge pin (37), a first torsion spring (35), a middle hinge pin (36), a second torsion spring (34) and a second hinge pin (32), wherein a U-shaped support piece (31) is welded to the rear end of each said bottom support tube (23), which is formed with a slot (30) corresponding to a front end of the U-shaped support piece (31);

a notch is formed in an upper end of the torsion spring connecting base (27), a horizontal opening allowing the connecting cover (6) to retreat in or stretch out is formed in one side of the notch, the second hinge pin (32) penetrates through the connecting cover (6) mounted in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the first torsion spring (35), a lower end of the torsion spring connecting base (27) and the U-shaped support piece (31) are rotatably connected through the middle hinge pin (36); one end of the first torsion spring (35) is inserted into the slot (30), and another end of the first torsion spring (35) is clamped in a clamping groove of a spring clamping plate (38) of the torsion spring connecting base (27).

13. The reclinable director chair according to claim 11, wherein the connector (5) comprises a leaf spring connecting base (45), a connecting cover (6), a first hinge pin (37), a leaf spring (41), an elastic element mounting shaft (43), a middle hinge pin (36), a second torsion spring (34) and a second hinge pin (32), wherein a U-shaped support piece (31) is welded to the rear end of each said bottom support tube (23), which is formed with a fork hole (46) corresponding to a front end of the U-shaped support piece (31);

a notch is formed in an upper end of the spring connecting base (45), a horizontal opening allowing the connecting cover (6) to retreat in or stretch out to cover the horizontal opening of the notch is formed in one side of the notch, the second hinge pin (32) penetrates through the connecting cover (6) in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the leaf spring (41) is of a bent structure and stretches to a lower end of the torsion spring connecting base (27) to be wound on the middle hinge pin (36), a first edge of the leaf spring (41) is inserted into the fork hole (46), a second edge of the leaf spring (41) is clamped in a concave groove below the leaf spring connecting base (45), and a lower end of the leaf spring connecting base (45) and the U-shaped support piece (31) are rotatably connected through the middle hinge pin (36).

14. The reclinable director chair according to claim 11, wherein each said cross tube (3) is of an n-shaped structure formed by a horizontal rod and two symmetrical vertical rods, the vertical rods of the two cross tubes (3) are riveted, and two ends of each said cross rod are riveted to the two vertical tubes of one said seat frame armrest tube (9); and the chair cloth (1) is in an L-shape, two vertical sleeve tubes (7) are arranged on a back of the backrest of the chair cloth (1) and are disposed around backrest support tubes (19), and horizontal sleeve tubes (8) are arranged on two sides of the cushion of the chair cloth (1) and are disposed around the horizontal rods (8).

15. The reclinable director chair according to claim 1, wherein the connector (5) comprises a torsion spring connecting base (27), a connecting cover (6), a first hinge pin (37), a first torsion spring (35), a middle hinge pin (36), a second torsion spring (34) and a second hinge pin (32), wherein a U-shaped support piece (31) is welded to the rear end of each said bottom support tube (23), which is formed with a slot (30) corresponding to a front end of the U-shaped support piece (31);

a notch is formed in an upper end of the torsion spring connecting base (27), a horizontal opening allowing the connecting cover (6) to retreat in or stretch out is formed in one side of the notch, the second hinge pin (32) penetrates through the connecting cover (6) mounted in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the first torsion spring (35), a lower end of the torsion spring connecting base (27) and the U-shaped support piece (31) are rotatably connected through the middle hinge pin (36); one end of the first torsion spring (35) is inserted into the slot (30), and another end of the first torsion spring (35) is clamped in a clamping groove of a spring clamping plate (38) of the torsion spring connecting base (27).

16. The reclinable director chair according to claim 1, wherein the connector (5) comprises a leaf spring connecting base (45), a connecting cover (6), a first hinge pin (37), a leaf spring (41), an elastic element mounting shaft (43), a middle hinge pin (36), a second torsion spring (34) and a second hinge pin (32), wherein a U-shaped support piece (31) is welded to the rear end of each said bottom support tube (23), which is formed with a fork hole (46) corresponding to a front end of the U-shaped support piece (31);

a notch is formed in an upper end of the spring connecting base (45), a horizontal opening allowing the connecting cover (6) to retreat in or stretch out to cover the horizontal opening of the notch is formed in one side of the notch, the second hinge pin (32) penetrates through the connecting cover (6) in the horizontal opening, and the second torsion spring (34), one end of the second torsion spring (34) is clamped in a clamping groove in the horizontal opening, another end of the second torsion spring (34) is clamped in a torsion spring groove (39) in a lower surface of the connecting cover (6), and a clamping protrusion (33) is arranged on an outer edge of an upper surface of the connecting cover (6); and sliding grooves (40) are formed in two sides of the notch, and the first hinge pin (37) penetrates through the sliding grooves (40) to be rotatably connected to the rear end of one said seat frame armrest tube (9);

the leaf spring (41) is of a bent structure and stretches to a lower end of the torsion spring connecting base (27) to be wound on the middle hinge pin (36), a first edge of the leaf spring (41) is inserted into the fork hole (46), a second edge of the leaf spring (41) is clamped in a concave groove below the leaf spring connecting base (45), and a lower end of the leaf spring connecting base (45) and the U-shaped support piece (31) are rotatably connected through the middle hinge pin (36).

17. The reclinable director chair according to claim 1, wherein each said cross tube (3) is of an n-shaped structure formed by a horizontal rod and two symmetrical vertical rods, the vertical rods of the two cross tubes (3) are riveted, and two ends of each said cross rod are riveted to the two vertical tubes of one said seat frame armrest tube (9); and the chair cloth (1) is in an L-shape, two vertical sleeve tubes (7) are arranged on a back of the backrest of the chair cloth (1) and are disposed around backrest support tubes (19), and horizontal sleeve tubes (8) are arranged on two sides of the cushion of the chair cloth (1) and are disposed around the horizontal rods (8).

18. The reclinable director chair according to claim 1, wherein the seat frame assembly further comprises four protective sleeves (10), two connecting iron sheets (12) and two bent iron sheets (16), wherein the protective sleeves (10) are riveted to vertical tubes of the seat frame armrest tubes (9), the two protective sleeves (10) on one said seat frame armrest tube (9) are connected to the two bent iron sheets (16), the two protective sleeves (10) on the other seat frame armrest tube (9) are connected to the two connecting iron sheets (12), another ends of the two connecting iron sheets (12) are riveted to the two vertical rods of one said cross tube (3), and the two bent iron sheets (16) are riveted to the two vertical rods of the other cross tube (3).

19. The reclinable director chair according to claim 18, wherein the seat frame assembly further comprises four plastic buckles (11), one said plastic buckle (11) is arranged on an upper side of each said connecting iron sheet (12), one said plastic buckle (11) is arranged on an upper side of each said bent iron sheet (16), and when the two cross tubes (3) are in an unfolded state, the horizontal rods of the two cross tubes press against the plastic buckles (11).

20. The reclinable director chair according to claim 19, wherein the seat frame assembly further comprises U-shaped leaf springs (20), wherein a protrusion (18) is arranged on a U-shaped face of one side of each said U-shaped leaf spring (20), a throat is formed at a lower end of each said backrest support tube (19), a through hole is formed in a periphery of each said throat, the U-shaped springs (20) are arranged in inner cavities of the throats in a sleeved manner, and the protrusion (18) stretches out of the through holes;

a vertical opening is formed in an upper portion of the rear end of each said seat frame armrest tube (9), holes (17) are formed in side walls of the vertical openings, the throats at the lower ends of the backrest support tubes (19) having the U-shaped leaf springs (20) mounted thereon are inserted into the vertical openings, and the protrusions (18) stretch out of the holes (17).

* * * * *